US008569941B2

(12) United States Patent
Yang et al.

(10) Patent No.: US 8,569,941 B2
(45) Date of Patent: Oct. 29, 2013

(54) DIAMONDOID MONOLAYERS AS ELECTRON EMITTERS

(75) Inventors: Wanli Yang, El Cerrito, CA (US); Jason D. Fabbri, San Francisco, CA (US); Nicholas A. Melosh, Menlo Park, CA (US); Zahid Hussain, Orinda, CA (US); Zhi-Xun Shen, Stanford, CA (US)

(73) Assignees: The Board of Trustees of the Leland Stanford Junior University, Stanford, CA (US); The Regents of the University of California, Oakland, CA (US)

( * ) Notice: Subject to any disclaimer, the term of this patent is extended or adjusted under 35 U.S.C. 154(b) by 0 days.

(21) Appl. No.: 13/442,563

(22) Filed: Apr. 9, 2012

(65) Prior Publication Data

US 2012/0212153 A1 Aug. 23, 2012

Related U.S. Application Data

(63) Continuation of application No. 11/704,910, filed on Feb. 12, 2007, now Pat. No. 8,154,185.

(51) Int. Cl.

| | |
|---|---|
| ***H01J 1/30*** | (2006.01) |
| ***H01J 1/312*** | (2006.01) |
| ***H01J 1/304*** | (2006.01) |
| ***H01J 19/24*** | (2006.01) |

(52) U.S. Cl.
USPC ..... 313/311; 313/495; 313/309

(58) Field of Classification Search
USPC ..... 313/495–497, 309–311
See application file for complete search history.

(56) References Cited

U.S. PATENT DOCUMENTS

| | | | | |
|---|---|---|---|---|
| 3,457,318 | A | 7/1969 | Capaldi et al. | |
| 3,832,332 | A | 8/1974 | Thompson et al. | |
| 5,017,734 | A | 5/1991 | Baum et al. | |
| 5,414,189 | A | 5/1995 | Chen et al. | |
| 5,977,697 | A | 11/1999 | Jin et al. | |
| 6,146,230 | A | 11/2000 | Kim et al. | |
| 6,235,851 | B1 | 5/2001 | Ishii et al. | |
| 6,553,096 | B1 | 4/2003 | Zhou et al. | |
| 6,783,589 | B2 | 8/2004 | Dahl et al. | |
| 7,160,529 | B2 | 1/2007 | Dahl et al. | |
| 2001/0015604 | A1 | 8/2001 | Kerslick et al. | |
| 2005/0127814 | A1 * | 6/2005 | Deguchi et al. | 313/495 |

OTHER PUBLICATIONS

Drummond et al. "Electron Emission from Diamondoids: A Diffusion Quantum Monte Carlo Study", The American Physical Society, Phys Rev Lett 95, 096801 p. 1-4, Aug. 26, 2005.*
Balaban et al, "Systematic Classification and Nomenclature of Diamond Hydrocarbons-I," *Tetrahedron* 34:3599-3609 (1978).
Dresslehaus et al., "Nanotechnology and Carbon Materials", *Nanotechnology*, Chapter 7, pp. 285-329, Springer-Verlag, New York, (1999).

(Continued)

*Primary Examiner* — Mariceli Santiago
(74) *Attorney, Agent, or Firm* — Merchant & Gould

(57) ABSTRACT

Provided are electron emitters based upon diamondoid monolayers, preferably self-assembled higher diamondoid monolayers. High intensity electron emission has been demonstrated employing such diamondoid monolayers, particularly when the monolayers are comprised of higher diamondoids. The application of such diamondoid monolayers can alter the band structure of substrates, as well as emit monochromatic electrons, and the high intensity electron emissions can also greatly improve the efficiency of field-effect electron emitters as applied to industrial and commercial applications.

13 Claims, 5 Drawing Sheets

Three Terminal Field Emission Device

(56) References Cited

OTHER PUBLICATIONS

Erdemir et al., "Tribology of Diamond, Diamond-Like Carbon, and Related Films", *Modern Tribology Handbook*, vol. Two, B. Bhushan, Ed. p. 871-908, CRC Press, Boca Raton (2001).

Fort Jr., et al., "Adamantine: Consequences of the Diamondoid Structure", *Chem. Rev*. 64:277-299 (1964).

Gruen, D.M., "Properties, Growth and Applications of Diamond", edited by M.H. Nazare and A. J. Neves, pp. 307-312, Inspec, London (2001).

Lin et al., Natural Occurrence of Tetramantane ($C_{22}$ $H_{28}$ ), Pentamantane ($C_{26}$ $H_{32}$ ) and Hexamantane ($C_{30}$ $H_{36}$ ) in a Deep Petroleum Reservoir, *Fuel* 74(l0):1512-1521 (1995).

McKervey et al., "Synthetic Approaches to Large Diamondoid Hydrocarbons", *Tetrahedron* 36:971-992 (1980).

Prawer, S., "The Wonderful World of Carbon", *Physics of Novel Materials*, M.P. Das, Ed., World Scientific, Singapore, pp. 205-234 (1999).

Zhu et al., "Novel Cold Cathode Materials" *Vacuum Microelectronics*, Chapter 6, W. Zhu, Ed., pp. 247-287, John Wiley & Sons, New York (2001).

International Search Report from corresponding International Patent Application No. PCT/US08/001597, dated Jun. 23, 2008.

* cited by examiner

Three Terminal Field Emission Device

Two Terminal Device

DIAMONDOID MONOLAYERS AS ELECTRON EMITTERS

CROSS-REFERENCE TO RELATED APPLICATION

This application is a continuation of U.S. patent application Ser. No. 11/704,910, filed Feb. 12, 2007, the contents of which are incorporated herein by reference in its entirety.

STATEMENT OF GOVERNMENTAL SUPPORT

This invention was made with Government support under contract numbers DE-AC03-76SF00098 and DE-AC02-76SF-00515 awarded by the Department of Energy, 0304981 awarded by the National Science Foundation, and N00014-04-1-0048 awarded by the Office of Naval Research. The Government has certain rights in this invention.

FIELD OF THE INVENTION

Monolayers of diamondoids, particularly higher diamondoids, have been found to provide surprising electron emission. Use of such materials can be realized in improved field emission devices.

DESCRIPTION OF THE RELATED ART

Carbon-containing materials offer a variety of potential uses in microelectronics. As an element, carbon displays a variety of different structures, some crystalline, some amorphous, and some having regions of both, but each form having a distinct and potentially useful set of properties.

A review of carbon's structure-property relationships has been presented by S. Prawer in a chapter titled "The Wonderful World of Carbon," in Physics of Novel Materials (World Scientific, Singapore, 1999), pp. 205-234. Prawer suggests the two most important parameters that may be used to predict the properties of a carbon-containing material are, first, the ratio of $sp^2$ to $sp^3$ bonding in a material, and second, microstructure, including the crystallite size of the material, i.e. the size of its individual grains.

Elemental carbon has the electronic structure $1s^2 2s^2 2p^2$, where the outer shell 2s and 2p electrons have the ability to hybridize according to two different schemes. The so-called $sp^3$ hybridization comprises four identical $\sigma$ bonds arranged in a tetrahedral manner. The so-called $sp^2$-hybridization comprises three trigonal (as well as planar) $\sigma$ bonds with an unhybridized p electron occupying a $\pi$ orbital in a bond oriented perpendicular to the plane of the $\sigma$ bonds. At the "extremes" of bonding structure are diamond and graphite. In diamond, all the carbon atoms are tetrahedrally bonded with $sp^3$-hybridization. Graphite comprises planar "sheets" of purely $sp^2$-hybridized atoms, where the sheets interact weakly through perpendicularly oriented $\pi$ bonds. Carbon exists in other morphologies as well, including amorphous and mixed diamond/graphite forms often called "diamond-like carbon," and amorphous carbon ($\alpha$-C), as well as the highly symmetrical spherical and rod-shaped structures called "fullerenes" and "nanotubes," respectively.

Diamond is an exceptional material because it scores highest in a number of different categories of properties. Not only is it the hardest material known, but it has the highest thermal conductivity of any material at room temperature. It displays superb optical transparency from the infrared through the ultraviolet, has the highest refractive index of any transparent material, and is an excellent electrical insulator because of its very wide bandgap. It also displays high electrical breakdown strength, and very high electron and hole mobilities. However, diamond as a microelectronics platform has the drawback of being expensive, difficult to dope (in particular for n-type donors) and large areas pieces are not available.

Attempts to synthesize diamond films using chemical vapor deposition (CVD) techniques date back to about the early 1980's. An outcome of these efforts was the appearance of new forms of carbon, largely amorphous, in nature, yet containing a high degree of $sp^3$-hybridized bonds, and thus displaying many of the characteristics of diamond. To describe such films the term "diamond-like carbon" (DLC) was coined, although this term has no precise definition in the literature. In "The Wonderful World of Carbon," Prawer teaches that since most diamond-like materials display a mixture of bonding types, the proportion of carbon atoms which are four-fold coordinated (or $sp^3$-hybridized) is a measure of the "diamond-like" content of the material. Unhybridized p electrons associated with $sp^2$-hybridization form $\pi$ bonds in these materials, where the $\pi$ bonded electrons are predominantly delocalized. This gives rise to the enhanced electrical conductivity of materials with $sp^2$ bonding, such as graphite. In contrast, $sp^3$-hybridization results in the extremely hard, electrically insulating and transparent characteristics of diamond. The hydrogen content of a diamond-like material will be directly related to the type of bonding it has. In diamond-like materials the bandgap gets larger as the hydrogen content increases, and hardness often decreases, reflecting the change in the amount of $sp^2$ vs $sp^3$ bonding.

Nonetheless, it is generally accepted that the term "diamond-like carbon" may be used to describe two different classes of amorphous carbon films, one denoted as "a:C—H," because hydrogen acts to terminate dangling bonds on the surface of the film, and a second hydrogen-free version given the name "ta-C" because a majority of the carbon atoms are tetrahedrally coordinated with $sp^3$-hybridization. The remaining carbons of ta-C are surface atoms that are substantially $sp^2$-hybridized. In a:C—H, dangling bonds can relax to the $sp^2$ (graphitic) configuration. The role hydrogen plays in a:C—H is to prevent unterminated carbon atoms from relaxing to the graphite structure. The greater the $sp^3$ content the more "diamond-like" the material is in its properties such as thermal conductivity and electrical resistance.

In his review article, Prawer states that tetrahedral amorphous carbon (ta-C) is a random network showing short-range ordering that is limited to one or two nearest neighbors, and no long-range ordering. There may be present random carbon networks that may comprise 3, 4, 5, and 6-membered carbon rings. Typically, the maximum $sp^3$ content of a ta-C film is about 80 to 90 percent. Those carbon atoms that are $sp^2$ bonded tend to group into small clusters that prevent the formation of dangling bonds. The properties of ta-C depend primarily on the fraction of atoms having the $sp^3$, or diamond-like configuration. Unlike CVD diamond, there is no hydrogen in ta-C to passivate the surface and to prevent graphite-like structures from forming. The fact that graphite regions do not appear to form is attributed to the existence of isolated $sp^2$ bonding pairs and to compressive stresses that build up within the bulk of the material.

The microstructure of a diamond and/or diamond-like material further determines its properties, to some degree because the microstructure influences the type of bonding content. As discussed in "Microstructure and grain boundaries of ultrananocrystalline diamond films" by D. M. Gruen, in Properties, Growth and Applications of Diamond, edited by M. H. Nazare and A. J. Neves (Inspec, London, 2001), pp. 307-312, recently efforts have been made to synthesize diamond having crystallite sizes in the "nano" range rather than the "micro" range, with the result that grain boundary chemistries may differ dramatically from those observed in the bulk. Nanocrystalline diamond films have grain sizes in the three to five nanometer range, and it has been reported that nearly 10 percent of the carbon atoms in a nanocrystalline diamond film reside in grain boundaries.

In Gruen's chapter, the nanocrystalline diamond grain boundary is reported to be a high-energy, high angle twist grain boundary, where the carbon atoms are largely π-bonded. There may also be $sp^2$ bonded dimers, and chain segments with $sp^3$-hybridized dangling bonds. Nanocrystalline diamond is apparently electrically conductive, and it appears that the grain boundaries are responsible for the electrical conductivity. The author states that a nanocrystalline material is essentially a new type of diamond film whose properties are largely determined by the bonding of the carbons within grain boundaries.

Another allotrope of carbon known as the fullerenes (and their counterparts carbon nanotubes) has been discussed by M. S. Dresslehaus et al. in a chapter entitled "Nanotechnology and Carbon Materials," in Nanotechnology (Springer-Verlag, New York, 1999), pp. 285-329. Though discovered relatively recently, these materials already have a potential role in microelectronics applications. Fullerenes have an even number of carbon atoms arranged in the form of a closed hollow cage, wherein carbon-carbon bonds on the surface of the cage define a polyhedral structure. The fullerene in the greatest abundance is the $C_{60}$ molecule, although $C_{70}$ and $C_{80}$ fullerenes are also possible. Each carbon atom in the $C_{60}$ fullerene is trigonally bonded with $sp^2$-hybridization to three other carbon atoms.

$C_{60}$ fullerene is described by Dresslehaus as a "rolled up" graphine sheet forming a closed shell (where the term "graphine" means a single layer of crystalline graphite). Twenty of the 32 faces on the regular truncated icosahedron are hexagons, with the remaining 12 being pentagons. Every carbon atom in the $C_{60}$ fullerene sits on an equivalent lattice site, although the three bonds emanating from each atom are not equivalent. The four valence electrons of each carbon atom are involved in covalent bonding, so that two of the three bonds on the pentagon perimeter are electron-poor single bonds, and one bond between two hexagons is an electron-rich double bond. A fullerene such as $C_{60}$ is further stabilized by the Kekulé structure of alternating single and double bonds around the hexagonal face.

Dresslehaus et al. further teach that, electronically, the $C_{60}$ fullerene molecule has 60 π electrons, one π electronic state for each carbon atom. Since the highest occupied molecular orbital is fully occupied and the lowest un-occupied molecular orbital is completely empty, the $C_{60}$ fullerene is considered to be a semiconductor with very high resistivity. Fullerene molecules exhibit weak van der Waals cohesive interactive forces toward one another when aggregated as a solid.

The following table summarizes a few of the properties of diamond, DLC (both ta-C and a:C—H), graphite, and fullerenes:

| Property | Diamond | ta-C | A:C—H | Graphite | $C_{60}$ Fullerene |
|---|---|---|---|---|---|
| C—C bond length (nm) | 0.154 | ≈0.152 | | 0.141 | Pentagon: 0.146 |
| Density ($g/cm^3$) | 3.51 | >3 | 0.9-2.2 | 2.27 | 1.72 |

-continued

| Property | Diamond | ta-C | A:C—H | Graphite | $C_{60}$ Fullerene |
|---|---|---|---|---|---|
| Hardness (Gpa) | 100 | >40 | <60 | Soft | Van der Waals |
| Thermal conductivity (W/mK) | 2000 | 100-700 | | 10 | 0.4 |
| Bandgap (eV) | 5.45 | ≈3 | 0.8-4.0 | Metallic | 1.7 |
| Electrical resistivity (Ωcm) | $>10^{16}$ | | $10^2$-$10^{12}$ | $10^{-3}$-1 | $>10^8$ |
| Refractive Index | 2.4 | 2-3 | 1.8-2.4 | — | — |

The data in the table is compiled from p. 290 of the Dresslehaus et al. reference cited above, p. 221 of the Prawer reference cited above, p. 891 a chapter by A. Erdemir et al. in "Tribology of Diamond, Diamond-Like Carbon, and Related Films," in Modern Tribology Handbook, Vol. Two, B. Bhushan, Ed. (CRC Press, Boca Raton, 2001), and p. 28 of "Deposition of Diamond-Like Superhard Materials," by W. Kulisch, (SpringerVerlag, New York, 1999).

A form of carbon not discussed extensively in the literature are "diamondoids." Diamondoids are molecular-sized fragments of the diamond crystal structure, and may consist of one or more fused unit cells. These compounds have a "diamondoid" topology in that their carbon atom arrangements are superimposable on a fragment of an FCC (face centered cubic) diamond lattice. Diamondoids can also be considered bridged-ring cycloalkanes, and comprise adamantane, diamantane, triamantane, and the tetramers, pentamers, hexamers, heptamers, octamers, nonamers, decamers, etc., of adamantane (tricyclo[3.3.1.1$^3$,7] decane), adamantane having the stoichiometric formula $C_{10}H_{16}$, in which various adamantane units are face-fused to form larger structures. These adamantane units are essentially subunits of diamondoids. Unlike diamond, the diamondoid surfaces are entirely $sp^3$-hybridized, with hydrogen-terminated surfaces.

Diamondoids are highly unusual forms of carbon because while they are hydrocarbons, with molecular sizes ranging in general from about 0.2 to 20 nm (averaged in various directions), they also retain some of the extraordinary properties of diamond. As hydrocarbons they can self-assemble into a van der Waals solid, possibly in a repeating array with each diamondoid assembling in a specific orientation. The solid results from cohesive dispersive forces between adjacent C—$H_x$ groups, and is known as a molecular solid. Alternatively, these diamondoids can be arranged or derivatized to arrange into molecular monolayers. These thin films are one molecule thick and intimately associated with their substrate, and can cover a large surface area. Thin films, with thicknesses between monolayers and bulk molecular solids are also possible.

Electron emitters are critical components of many current and future electronic devices. Recently, intensive efforts have been put toward inventing thin and low power consuming flat-panel displays. Field emission displays (FEDs), also called surface-conduction electron-emission displays (SEDs), are among the most promising techniques emerging from these efforts. Along these lines most of the major display manufacturers have launched their own FED projects in an attempt to top the huge market of flat-panel displays. According to market research company IDC, the television market alone will climb up to about $40 billion in the coming year.

A field-emission electron emitter is the heart of FED technology. Finding materials for emission sources is the most crucial issue. Original field-emission emitters are made from micro-tips of refractory metals like Molybdenum or Tungsten. By applying a strong electric field at the apex of the tip, electrons are emitted through a process known as field emission. Although micro-tip based field-emission emitters have been partially used for electron microscopes, they failed the display industry due to the high fabrication cost and short life time.

Carbon nanotubes are another candidate as a material for field-emission electron emitters. They feature high electron emission density and long life time, and aligned nanotube emitters have been fabricated. Prototype carbon nanotube based FED's were announced by Samsung in 2001, however, there is still no commercial product. The difficulties in making carbon nanotube based electronics rest with both the impurities and the unavoidable mixture of various types of tubes from the synthesis. So far, no low-cost route to substantial quantities of one type carbon nanotubes is available.

U.S. Pat. No. 7,160,529 describes the use of diamondoids in field emission devices. This discovery has great potential for improving field emission devices and their use in industrial and commercial applications. However, the previous work is unclear about the proper manner in which to make diamondoid field emitters and deals with molecular solid materials.

It should be noted that a field emission cathode comprising a diamond or unmodified molecular diamondoid electrode may suffer from poor electrical conductivity This is because of the wide bandgap of diamond. In a normal situation, few electrons are able to traverse the bandgap, in other words, move from electronic states in the valence band to electronic states in the conduction band. While electrons in the conduction band may be able to emit into the vacuum level for negative electron affinity (NEA) materials, such as hydrogen-terminated diamond surfaces, exciting electrons from the valence band into the conduction band to make them available for field emission may still be problematic. Thus, diamond is generally thought to be unable to sustain electron emission because of its insulating nature. To reiterate, although electrons may easily escape into the vacuum from the surface of a hydrogenated diamond film, due to the negative electron affinity of that surface, the problem is that there are no readily available mechanisms by which electrons may be excited from the bulk into electronic surface states.

SUMMARY OF THE INVENTION

The present invention provides improved electron emitters comprised of a monolayer of a diamondoid or functionalized diamondoid, most preferably a higher diamondoid, on a suitable substrate. The monolayer is generally a self-assembled monolayer (SAM). The resulting electron emitters demonstrate high-intensity electron emission. Such high-intensity emission can resolve longstanding problems of conventional field-effect electron emitters, and greatly improve their efficiency.

Among other factors, it has been discovered that by employing a monolayer of a diamondoid, particularly a higher diamondoid, preferably selected from the group consisting of tetramantane, pentamantane, hexamantane, heptamantane, octamantane, nonamantane, decamantane, and undecamantane, efficient, high intensity electron emission can be realized. Use of the monolayer, preferably using self assembled monolayer techniques as is known in the industry, is important to realizing the focused, high intensity electron emissions. The application of such higher diamondoid monolayers can also alter the band structures of normally un-useful substrates, as well as permit the emission of monochromatic electrons. The focused, high intensity electron emissions can greatly improve the efficiency of field-effect electron emitters as applied to industrial and commercial applications, particularly flat-panel displays and X-ray detectors. This application also describes a method to use functionalized monolayers of diamondoids for field emission, rather than bulk molecular solids.

BRIEF DESCRIPTION OF THE DRAWING FIGURES

Figure 3:
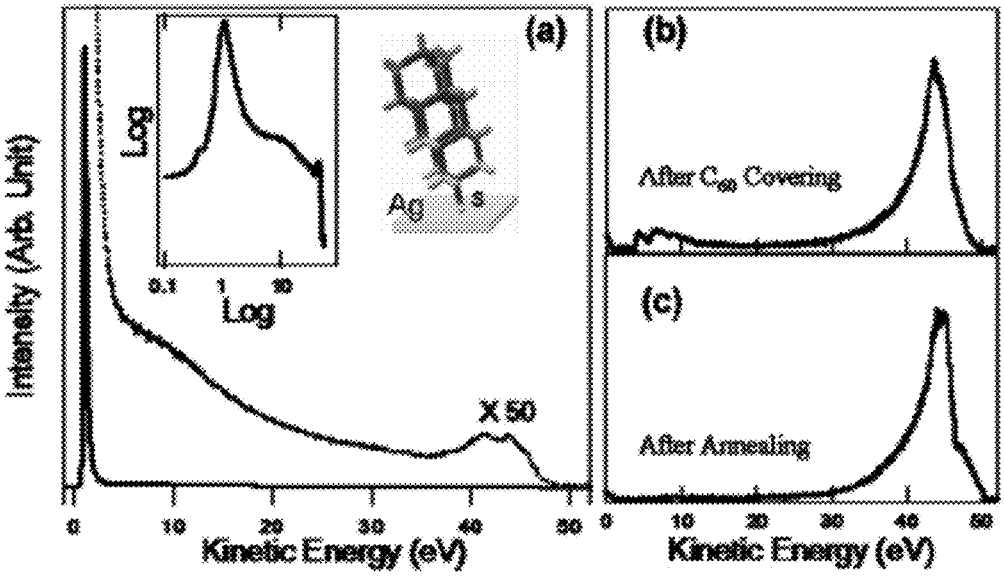

In FIG. 3 (*a*) Photoelectron spectra of [121] 6-tetramantanethiol SAMs grown on Ag substrates, collected with 55 eV photon energy. The uniquely strong peak at 1 eV contains 68% of the total photoelectrons. Dotted line is a 50 times blowup of valence band features which was suppressed by the strong peak. Inset shows the same spectra in double logarithm plot, a peak could still be seen with no exponential tail towards high kinetic energy. (b) Photoelectron spectrum collected on a $C_{60}$ covered 6-tetramantanethiol SAM. $C_{60}$ was sublimated in-situ towards the sample surfaces by heating up a well outgassed $C_{60}$ evaporator. The coverage is less than one monolayer, as approximately calibrated by a quartz thickness monitor. The pristine SAM exhibits the unusual electron emission peak which disappears after $C_{60}$ coverage. (c) Photoelectron spectrum collected on an annealed 6-tetramantanethiol SAM. Again, the peak observed for pristine SAM vanishes after the in-situ annealing to 825K. The difference between FIG. 3*c* and a typical Ag PES spectrum could be due to some sulphur atoms still bonded to the surface after annealing. (b) and (c) conclude that the unusual electron emission peak in (a) is generated by the tetramantanethiol molecules.

Figure 4:
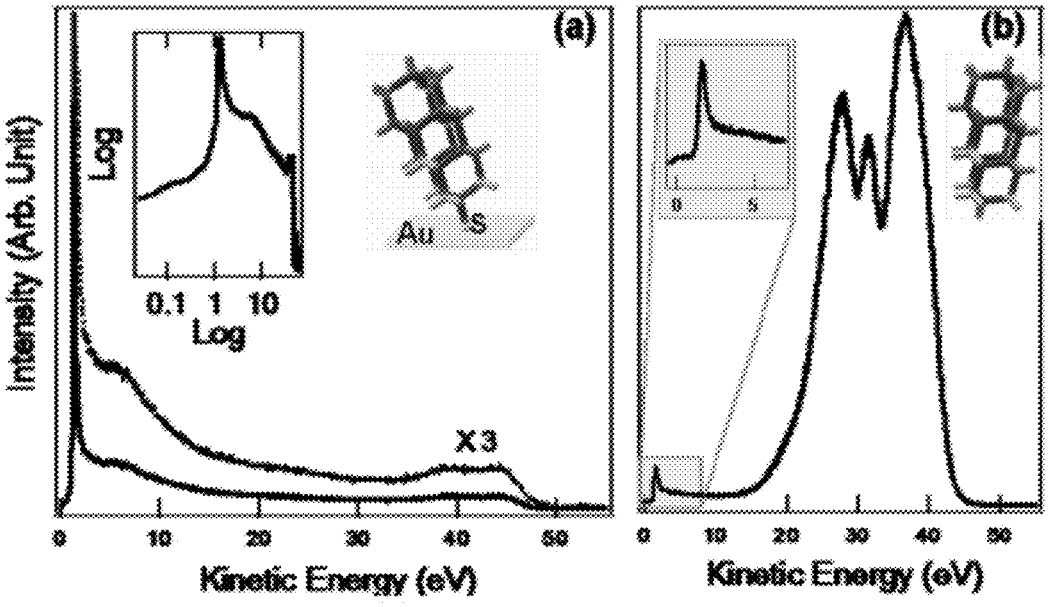

FIG. 4. (a) Photoelectron spectra of [121] 6-tetramantanethiol SAMs grown on Au substrates. The sharp peak at 1 eV contains about 17% of the total photoelectrons. Inset is a double logarithm plot, exhibiting the spike-like peak with no exponential tail. (b) Photoelectron spectra of [121] tetramantane films (without thiol) prepared in-situ by evaporating the tetramantane powder at 323-353K onto cleaned Au substrates. Inset is the blowup of the shaded area with only a weak peak, in sharp contrast with the data of tetramantanethiol.

Figure 5:
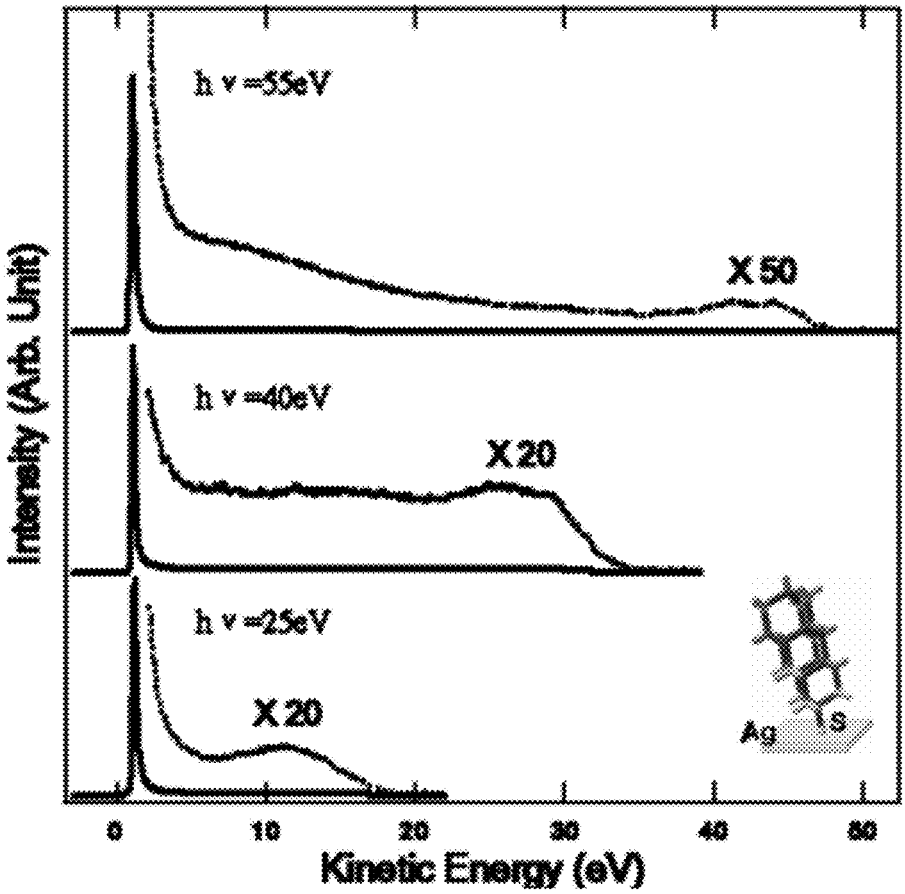

FIG. 5. Photoelectron spectra of [121] 6-tetramantanethiol SAMs on Ag collected with 25 eV, 40 eV, and 55 eV photon energy. The unusual electron emission peak at 1 eV persists. A quantitative analysis of the peak intensity upon photon energy turns out to be complicated, but it is evidently higher for 55 eV data compared with 40 eV and 25 eV data.

DETAILED DESCRIPTION OF THE PREFERRED EMBODIMENTS

According to embodiments of the present invention, diamondoids are provided, e.g., isolated from an appropriate feedstock, and then fabricated into a material that is specific for a particular microelectronics application. In the following discussion diamondoids will first be defined, followed by a description of how they may be recovered from petroleum feedstocks. After recovery diamondoids may be processed into polymers, sintered ceramics, and other forms of diamondoid-containing materials, depending on the application in which they are to be used.

Definition of Diamondoids

The term "diamondoids" refers to substituted and unsubstituted caged compounds of the adamantane series including adamantane, diamantane, triamantane, tetramantane, pentamantane, hexamantane, heptamantane, octamantane, nonamantane, decamantane, undecamantane, and the like, including all isomers and stereoisomers thereof. The compounds have a "diamondoid" topology, which means their carbon atom arrangement is superimposable on a fragment of an FCC diamond lattice. Substituted diamondoids comprise from 1 to 10 and preferably 1 to 4 independently-selected alkyl substituents. Diamondoids include "lower diamondoids" and "higher diamondoids," as these terms are defined herein, as well as mixtures of any combination of lower and higher diamondoids.

The term "lower diamondoids refers to adamantane, diamantane and triamantane and any and/or all unsubstituted and substituted derivatives of adamantane, diamantane and triamantane. These lower diamondoid components show no isomers or chirality and are readily synthesized, distinguishing them from "higher diamondoids."

The term "higher diamondoids" refers to any and/or all substituted and unsubstituted tetramantane components; to any and/or all substituted and unsubstituted pentamantane components; to any and/or all substituted and unsubstituted hexamantane components; to any and/or all substituted and unsubstituted heptamantane components; to any and/or all substituted and unsubstituted octamantane components; to any and/or all substituted and unsubstituted nonamantane components; to any and/or all substituted and unsubstituted decamantane components; to any and/or all substituted and unsubstituted undecamantane components; as well as mixtures of the above and isomers and stereoisomers of tetramantane, pentamantane, hexamantane, heptamantane, octamantane, nonamantane, decamantane, and undecamantane.

Adamantane chemistry has been reviewed by Fort, Jr. et al. in "Adamantane: Consequences of the Diamondoid Structure," Chem. Rev. vol. 64, pp. 277 300 (1964). Adamantane is the smallest member of the diamondoid series and may be thought of as a single cage crystalline subunit. Diamantane contains two subunits, triamantane three, tetramantane four, and so on. While there is only one isomeric form of adamantane, diamantane, and triamantane, there are four different isomers of tetramantane (two of which represent an enantiomeric pair), i.e., four different possible ways of arranging the four adamantane subunits. The number of possible isomers increases non-linearly with each higher member of the diamondoid series, pentamantane, hexamantane, heptamantane, octamantane, nonamantane, decamantane, etc.

Adamantane, which is commercially available, has been studied extensively. The studies have been directed toward a number of areas, such as thermodynamic stability, functionalization, and the properties of adamantane-containing materials. For instance, the following patents discuss materials comprising adamantane subunits: U.S. Pat. No. 3,457,318 teaches the preparation of polymers from alkenyl adamantanes; U.S. Pat. No. 3,832,332 teaches a polyamide polymer forms from alkyladamantane diamine; U.S. Pat. No. 5,017,734 discusses the formation of thermally stable resins from adamantane derivatives; and U.S. Pat. No. 6,235,851 reports the synthesis and polymerization of a variety of adamantane derivatives.

In contrast, the higher diamondoids, have received comparatively little attention in the scientific literature. McKervay et al. have reported the synthesis of anti-tetramantane in low yields using a laborious, multistep process in "Synthetic Approaches to Large Diamondoid Hydrocarbons," Tetrahedron, vol. 36, pp. 971 992 (1980). To the inventor's knowledge, this is the only higher diamondoid that has been synthesized to date. Lin et al. have suggested the existence of, but did not isolate, tetramantane, pentamantane, and hexamantane in deep petroleum reservoirs in light of mass spectroscopic studies, reported in "Natural Occurrence of Tetramantane ($C_{22}H_{28}$), Pentamantane ($C_{26}H_{32}$) and Hexamantane ($C_{30}H_{36}$) in a Deep Petroleum Reservoir," Fuel, vol. 74(10), pp. 1512 1521 (1995). The possible presence of tetramantane and pentamantane in pot material after a distillation of a diamondoid-containing feedstock has been discussed by Chen et al. in U.S. Pat. No. 5,414,189.

The four tetramantane structures are iso-tetramantane [1(2)3], anti-tetramantane [121] and two enantiomers of skew-tetramantane [123], with the bracketed nomenclature for these diamondoids in accordance with a convention established by Balaban et al. in "Systematic Classification and Nomenclature of Diamond Hydrocarbons-I," Tetrahedron vol. 34, pp. 3599 3606 (1978). All four tetramantanes have the formula $C_{22}H_{28}$ (molecular weight 292). There are ten possible pentamantanes, nine having the molecular formula $C_{26}H_{32}$ (molecular weight 344) and among these nine, there are three pairs of enantiomers represented generally by [12(1)3], [1234], [1213] with the nine enantiomeric pentamantanes represented by [12(3)4], [1(2,3)4], [1212]. There also exists apentamantane [1231] represented by the molecular formula $C_{25}H_{30}$ (molecular weight 330). Hexamantanes exist in thirty-nine possible structures with twenty eight having the molecular formula $C_{30}H_{36}$ (molecular weight 396) and of these, six are symmetrical; ten hexamantanes have the molecular formula $C_{29}H_{34}$ (molecular weight 382) and the remaining hexamantane [12312] has the molecular formula $C_{26}H_{30}$ (molecular weight 342).

Heptamantanes are postulated to exist in 160 possible structures with 85 having the molecular formula $C_{34}H_{40}$ (molecular weight 448) and of these, seven are achiral, having no enantiomers. Of the remaining heptamantanes 67 have the molecular formula $C_{33}H_{38}$ (molecular weight 434), six have the molecular formula $C_{32}H_{36}$ (molecular weight 420) and the remaining two have the molecular formula $C_{30}H_{34}$ (molecular weight 394).

Octamantanes possess eight of the adamantane subunits and exist with five different molecular weights. Among the octamantanes, 18 have the molecular formula $C_{34}H_{38}$ (molecular weight 446). Octamantanes also have the molecular formula $C_{38}H_{44}$ (molecular weight 500); $C_{37}H_{42}$ (molecular weight 486); $C_{36}H_{40}$ (molecular weight 472), and $C_{33}H_{36}$ (molecular weight 432).

Nonamantanes exist within six families of different molecular weights having the following molecular formulas: $C_{42}H_{48}$ (molecular weight 552), $C_{41}H_{46}$ (molecular weight 538), $C_{40}H_{44}$ (molecular weight 524, $C_{38}H_{42}$ (molecular weight 498), $C_{37}H_{40}$ (molecular weight 484) and $C_{34}H_{36}$ (molecular weight 444).

Decamantane exists within families of seven different molecular weights. Among the decamantanes, there is a single decamantane having the molecular formula $C_{35}H_{36}$ (molecular weight 456) which is structurally compact in relation to the other decamantanes. The other decamantane families have the molecular formulas: $C_{41}H_{52}$ (molecular weight 604); $C_{45}H_{50}$ (molecular weight 590); $C_{44}H_{48}$ (molecular weight 576); $C_{42}H_{46}$ (molecular weight 550); $C_{41}H_{44}$ (molecular weight 536); and $C_{38}H_{40}$ (molecular weight 496).

Undecamantane exists within families of eight different molecular weights. Among the undecamantanes there are two undecamantanes having the molecular formula $C_{39}H_{40}$ (molecular weight 508) which are structurally compact in relation to the other undecamantanes. The other undecamantane families have the molecular formulas $C_{41}H_{42}$ (molecular weight 534); $C_{42}H_{44}$ (molecular weight 548); $C_{45}H_{18}$ (molecular weight 588); $C_{46}H_{50}$ (molecular weight 602); $C_{48}H_{52}$ (molecular weight 628); $C_{49}H_{54}$ (molecular weight 642); and $C_{50}H_{56}$ (molecular weight 656).

Isolation of Diamondoids from Petroleum Feedstocks

Feedstocks that contain recoverable amounts of higher diamondoids include, for example, natural gas condensates and refinery streams resulting from cracking, distillation, coking processes, and the like. Particularly preferred feedstocks originate from the Norphlet Formation in the Gulf of Mexico and the LeDuc Formation in Canada.

These feedstocks contain large proportions of lower diamondoids (often as much as about two thirds) and lower but significant amounts of higher diamondoids (often as much as about 0.3 to 0.5 percent by weight). The processing of such feedstocks to remove non-diamondoids and to separate higher and lower diamondoids (if desired) can be carried out using, by way of example only, size separation techniques such as membranes, molecular sieves, etc., evaporation and thermal separators either under normal or reduced pressures, extractors, electrostatic separators, crystallization, chromatography, well head separators, and the like.

A preferred separation method typically includes distillation of the feedstock. This can remove low-boiling, non-diamondoid components. It can also remove or separate out lower and higher diamondoid components having a boiling point less than that of the higher diamondoid(s) selected for isolation. In either instance, the lower cuts will be enriched in lower diamondoids and low boiling point non-diamondoid materials. Distillation can be operated to provide several cuts in the temperature range of interest to provide the initial isolation of the identified higher diamondoid. The cuts, which are enriched in higher diamondoids or the diamondoid of interest, are retained and may require further purification. Other methods for the removal of contaminants and further purification of an enriched diamondoid fraction can additionally include the following nonlimiting examples: size separation techniques, evaporation either under normal or reduced pressure, sublimation, crystallization, chromatography, well head separators, flash distillation, fixed and fluid bed reactors, reduced pressure, and the like.

The removal of non-diamondoids may also include a pyrolysis step either prior or subsequent to distillation. Pyrolysis is an effective method to remove hydrocarbonaceous, non-diamondoid components from the feedstock. It is effected by heating the feedstock under vacuum conditions, or in an inert atmosphere, to a temperature of at least about 390° C., and most preferably to a temperature in the range of about 410 to 450° C. Pyrolysis is continued for a sufficient length of time, and at a sufficiently high temperature, to thermally degrade at least about 10 percent by weight of the non-diamondoid components that were in the feed material prior to pyrolysis. More preferably at least about 50 percent by weight, and even more preferably at least 90 percent by weight of the non-diamondoids are thermally degraded.

While pyrolysis is preferred in one embodiment, it is not always necessary to facilitate the recovery, isolation or purification of diamondoids. Other separation methods may allow for the concentration of diamondoids to be sufficiently high given certain feedstocks such that direct purification methods such as chromatography including preparative gas chromatography and high performance liquid chromatography, crystallization, fractional sublimation may be used to isolate diamondoids.

Even after distillation or pyrolysis/distillation, further purification of the material may be desired to provide selected diamondoids for use in the compositions employed in this invention. Such purification techniques include chromatography, crystallization, thermal diffusion techniques, zone refining, progressive recrystallization, size separation, and the like. For instance, in one process, the recovered feedstock is subjected to the following additional procedures: 1) gravity column chromatography using silver nitrate impregnated silica gel; 2) two-column preparative capillary gas chromatography to isolate diamondoids; 3) crystallization to provide crystals of the highly concentrated diamondoids.

An alternative process is to use single or multiple column liquid chromatography, including high performance liquid chromatography, to isolate the diamondoids of interest. As above, multiple columns with different selectivities may be used. Further processing using these methods allow for more refined separations which can lead to a substantially pure component.

In a preferred embodiment of the present invention, a diamondoid or diamondoid containing material is utilized as a cold cathode filament in a field emission device suitable for use, among other places, in flat panel displays. The unique properties of a diamondoid make this possible. These properties include the negative electron affinity of a hydrogenated diamond surface, in conjunction with the small size of a typical higher diamondoid molecule. The latter presents striking electronic features in the sense that the diamond material in the center of the diamondoid comprises high purity diamond single crystal, with the existence of significantly different electronic states at the surface of the diamondoid.

In a chapter entitled "Novel Cold Cathode Materials," in Vacuum Micro-electronics (Wiley, New York, 2001), pp. 247-287, written by W. Zhu et al., the requirements for a microtip field emitter array are given, as well as the properties an improved field emission cathode are expected to deliver. Perhaps the most difficult problem presented by a conventional field emission cathode is the high voltage that must be applied to the device in order to extract electrons from the filament. Zhu et al. report a typical control voltage for microtip field emitter array of about 50-100 volts because of the high work function of the material typically comprising a field emission cathode. Voltage requirements for diamondoid field emitters will be much smaller due to the fact that diamonds in general, and in particular a hydrogenated diamond surface, offer a unique solution to this problem because of the fact that a diamond surface displays an electron affinity that is negative. Diamondoids are single molecules, which our results show has negative electron affinity.

The electron affinity of the material is a function of electronic states at the surface of the material. When a diamond surface is passivated with hydrogen, that is to say, each of the carbon atoms on the surface are $sp^3$-hybridized, i.e., bonded to hydrogen atoms, the electron affinity of that hydrogenated diamond surface can become negative. The remarkable consequence of a surface having a negative electron affinity is that the energy barrier to an electron attempting to escape the material is energetically favorable and in a "downhill" direction.

In more specific terms, the electron affinity $\chi$ of a material is negative, where $\chi$ is defined to be the energy required to excite an electron from an electronic state at the minimum of the conduction band to the energy level of a vacuum. For most semiconductors, the minimum of the conduction band is below that of the vacuum level, so that the electron affinity of that material is positive. Electrons in the conduction band of such a material are bound to the semiconductor, and energy must be supplied to the semiconductor to excite and electron from the surface of that material, known as the work function.

Diamondoid SAMs also exhibit NEA behavior, and thus will readily emit electrons excited into the conduction band into vacuum. The voltage required for this process may be reduced due to diamondoid characteristics, functionalization, or size.

According to one embodiment of the present invention, a field emission cathode comprises a diamondoid, a derivatized diamondoid, a polymerized diamondoid, and all or any of the other diamondoid containing materials discussed in previous sections of this description. Many different geometries can be used, but two exemplary field emission cathodes comprising a diamondoid are shown in FIGS. 1 and 2.

Figure 1:
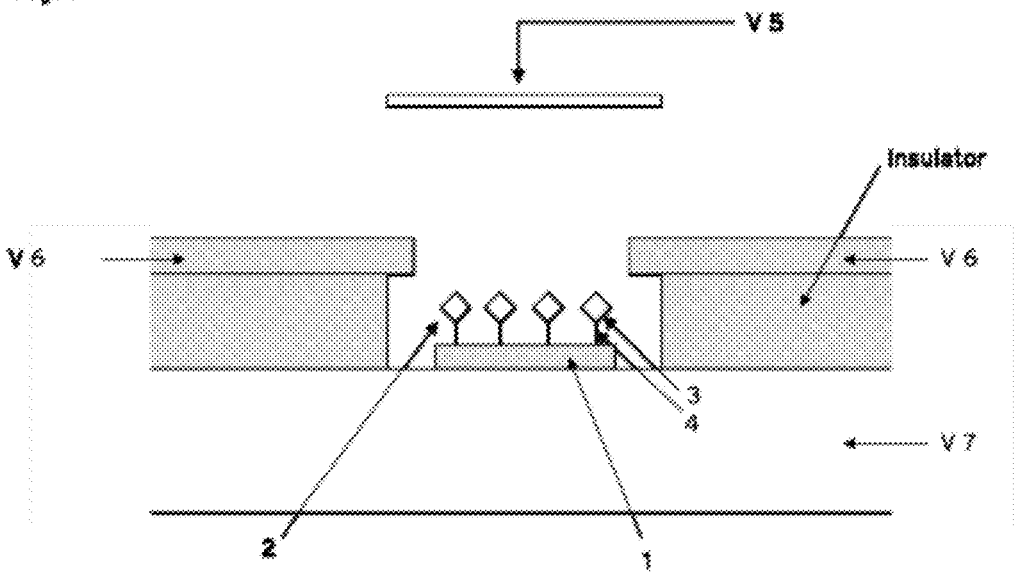
FIG. 1 depicts a typical three terminal field emission device.
Figure 2:
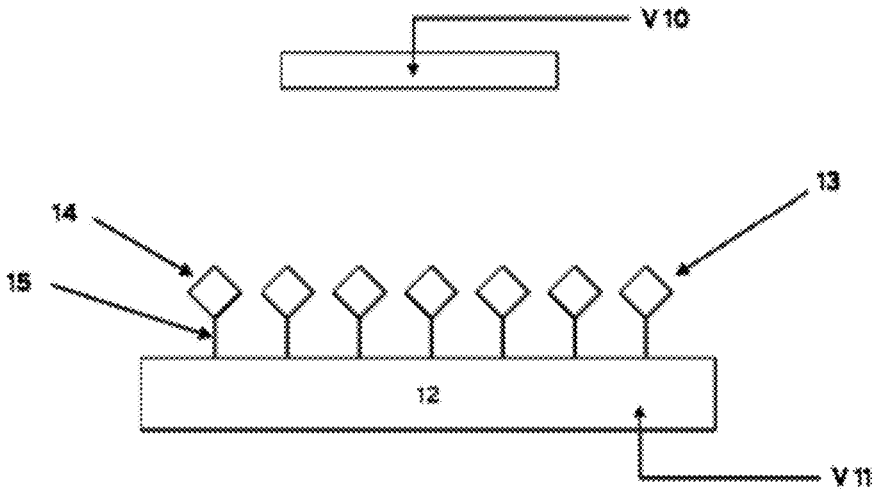
FIG. 2 depicts a typical two terminal field emission device.

Referring to FIG. 1, A three terminal field emission device is depicted generally. The device comprises a substrate 1 made of gold, another metal or semiconductive material such as silicon. On the substrate 1 is a diamondoid monolayer 2, comprised of a diamondoid 3. Preferably, the diamondoid is derivatized in order to better adhere to the substrate by means of a linker 4. The diamondoid derivative can be a thiol, silane, alkene, halogen, isocyanate, carbonyl, ether, siloxy or any suitably group with can create a stable connection to the underlying substrate. Any suitable attachment method generally known to the skilled artisan can be used.

The anode 5 of the device can be within a conductive layer positioned behind a phosphorescent coating, or simply an electrode 5 positioned adjacent to the cathode. As shown in FIG. 2, the anode 10 is adjacent the cathode 11. The cathode comprises the substrate 12 comprised of the diamondoid monolayer 13. The diamondoid 14 of the layer is preferably functionalized with a linking group 15 to better attach to the substrate 12.

In FIG. 1, the device depicted is operated in a "gated" fashion, wherein the bias exists between the "gate" electrode 6 and the cathode 7, which initiates electron emission, and the electrons are collected by a positive bias on the anode 5. A typical operating voltage (that is, the potential difference between the cathode and the anode or gate electrode) is between 5-200 volts. This is what allows the cathode to be operated in a so-called "cold" configuration. A typical electronic affinity for a diamondoid surface is contemplated to be less than about 3 eV, and in other embodiments it may be negative. An electron affinity that is less than about 3 eV is considered to be a "low positive value."

Although undoped diamond materials are generally considered electrically insulating, the diamondoid monolayer 2 may be small enough to allow electrons to tunnel (in a quantum mechanical sense) onto the diamondoid 3. This tunneling process may enable considerable current to pass through even an insulating molecule, which is a unique feature of diamondoid monolayers as opposed to thick films or bulk materials. It will be appreciated by those skilled in the art that it is not essential for the diamondoid monolayer to have an apex or tip, since the surface of the diamondoid is hydrogenated and $sp^3$-hybridized. In an alternative embodiment, the surface of the cathode may comprise a diamondoid-containing material that is at least partially derivatized such that the surface comprises both $sp^2$ and $sp^3$-hybridization.

An advantage of the present invention is that much greater resolution of the device may be realized relative to a conventional field emission device because of the small size of a typical diamondoid, derivatized diamondoid, self-assembled diamondoid structure, or diamondoid aggregate. The discovery of the surprisingly improved high intensity and efficient electron emission realized when using a diamondoid monolayer greatly advances this advantage.

We have shown that many different diamondoids can be chemically attached to a substrate (e.g. tetramantane thiol deposited on gold) to form SAMs. In addition, we have shown that SAMs made from tetramantane thiol on gold or silver shows unusual and unexpected field emission properties. They show strong NEA (even stronger than hydrogen terminated diamond itself) and most of the electrons are emitted at a relatively narrow wave length. These results will lead to improvements in flat panel display technology.

NEA based emitters have several advantages over microtip or nanotube field-emission emitters. First of all, NEA-based emitters should exhibit emission at very low "turn-on voltage", or the voltage necessary to achieve an appreciable amount of current. For display panels, low turn-on voltage means a reduction of black luminance, which is directly related to contrast ratio. Secondly, both thermionic and field-emission emitters exhibit fluctuations from the statistics of electron distributions, the so-called occupied states in the materials. On the contrary, the energy distribution of the emitted electron from a NEA material is extremely narrow, and the noise is mainly from the resistance. Therefore, NEA emitters feature high emission density and low noise.

NEA materials have long been sought due to their unique advantages. Some wide band semiconductors, for example, cesiated GaN, and H-terminated diamond surfaces have been studied for their NEA properties. Two critical issues blocked the way to commercialized products. One is the difficulty of supplying electrons to the emission surface, because the materials are wide band semiconductors. The other is the non-uniform emission normally observed on diamond surfaces, isolation from contaminants such as oxygen and water.

In the present invention, diamondoid based monolayer films are applied onto suitable substrates such as metal substrates and semiconductive substrates, e.g., gold, silver or silicon, and show strong evidence of NEA property. Since the electrons can be supplied by tunneling through a single molecule, and low voltages may be used, two of the critical problems for NEA emitters as mentioned above are resolved.

The commercialization of NEA diamondoid monolayer films is very straightforward. Langmuir-Blodgett (LB) and self-assembled monolayers (SAM) processing are mature techniques for sample preparation, and can be easily applied with the diamondoids to ensure a monolayer on a surface that is reasonably stable. In fact, measurements on SAM films were taken after the films were exposed to the air, and NEA still persisted. In addition, field emission may be enhanced by depositing Cs onto the surface. This is also a common technique in industry for reducing the work function of electron sources. In brief, electron emitters based on the NEA diamondoid monolayer films could simply replace conventional field emission devices and provide better properties. This replacement could conquer the several difficulties for commercializing field emission displays as discussed above.

In particular, a spectacularly sharp, strong and unique electron emission peak on self assembled monolayers (SAMs) of tetramantane-thiol was observed. The intensity of this superior peak contains up to 68% of the total number of emitted electrons, much higher than that of hydrogen terminated diamond. Spectral and energetic considerations suggest that the SAM of this diamondoid shows negative electron affinity. This finding directly demonstrates that monolayer films of diamondoids exceed bulk diamond and even thicker diamondoid films on some novel characteristics. The unique electron emission property provides opportunities for technological breakthroughs on electron emitters.

In addition, it is quite easy to make very large arrays of diamondoid SAMs. As such, the unusual electron emission properties of large-area self-assembled diamondoid monolayers (SAMs) are realized. Moreover, the diamondoid SAMs appear to act as molecular monochrometers which synchronize the energy of emitted electrons. Given the recent discoveries leading to the availability of many different diamondoids and the low cost for large scale manufacturing of diamondoid SAMs, field emission findings reveal special properties of diamondoids that circumvent problems encountered in bulk diamond, creating new windows of opportunity for possible breakthrough technologies in flat panel display, microwave amplifiers, electron microscopy and electron beam lithography, vacuum microelectronic devices, solid state lighting, and X-ray detectors.

EXAMPLES

The following three preparational/analytical methods were employed in the various examples provided thereafter, which are provided as illustrative, and are not meant to be limitative.

[Method 1] SAMs of [121] 6-tetramantane-thiol in centimeter size were prepared in solution at room temperature through a routine procedure (5-8). A layer of 3 nm Ti followed by 100 nm Au was deposited by e-beam evaporation at a base pressure of approximately $1\times10^{-6}$ torr onto either Cu or Ag substrates. The SAMs were grown by immersing the metal surfaces in solution for one to two days. Upon removal from solution, the films were washed in toluene and ethanol under $N_2$ environment, then immediately loaded into vacuum chamber.

[Method 2] NEXAFS spectra were recorded at beamlines 8.2 and 10.1 of the Stanford Synchrotron Radiation Laboratory (SSRL, SPEARIII) at the Stanford Linear Accelerator (SLAC). NEXAFS spectra were recorded using total electron yield, obtained by measuring the total current leaving the experimental sample as the X-ray energy was scanned across the absorption edge. The NEXAFS signals were normalized to the incident photon flux, as recorded by the TEY signal of a freshly gold coated grid in the beam. Note that the possible existence of multi-domains and/or imperfect dipole moments will lead to an overestimated angle by NEXAFS. However, it is clear that diamondoid molecules are roughly perpendicular to the sample surfaces with Sulphur at the bottom.

[Method 3] PES data were collected by using SCIENTA R4000 electron spectrometer at HERS endstation, BL10.0.1, Advanced Light Source (ALS). Firstly, the SAMs were very gently degassed, sometimes by annealing to about 300K, before exposed to synchrotron beam. The linear polarization of the incident beam is 20 degree off the sample surface. All the data were taken with pass energy as low as 2 eV, and samples were biased from 0 to −9 volts to exceed the spectrometer work function as well as to check the reliability of the low kinetic energy data. We observed obvious change in the spectra after a certain period of beam exposure. All the PES data shown here were collected at 30K with less than 20 minutes of the X-ray exposure; no sign of radiation damage on PES spectra was detected under this condition.

Large-area SAMs of a functionalized diamondoid, [121] 6-tetramantane-thiol, were grown on Ag or Au substrates through a routine procedure (Method 1). Near edge X-ray absorption fine structure (NEXAFS) measurements were carried out to investigate the detailed molecular geometry (Method 2). We then performed photoelectron spectroscopy (PES) experiments at BL10.0.1, Advanced Light Source, Lawrence Berkeley National Laboratory. Different samples on different substrates with different bias voltages (0-9V) were measured to check the reproducibility (Method 3).

Polarization-dependent NEXAFS on C 1s were used to characterize molecular orientation of the SAMs. The polarization selection rules are simple for transitions from C 1s core level to C 2p orbitals, i.e., the absorption intensity of an orbital depends directly on how the beam polarization is aligned with the orbital. The spectrum with 90° angle exhibits the strongest intensity for the (C—H) σ* peak, meaning the (C—H) orbitals lie more or less parallel to the sample surface. Additionally, the affinity of the thiol for the metal substrate bonds the sulphur at the bottom of the SAMs, bridging the diamondoids and the metal substrates, as can be easily verified by standard X-ray photoelectron spectroscopy (XPS). By comparing the experimental intensity ratio with the theoretical simulation, we get the best agreement if the 6-tetramantane-thiol molecules are tilted for about 30° from the normal to the surface (Method 2).

FIGS. 3 and 4 present the PES spectrum collected on [121] 6-tetramantane-thiol SAMs grown on Ag (FIG. 3*a*) and Au (FIG. 4*a*) substrates. An outstanding emission peak appears for both surfaces at about 1 eV kinetic energy, the onset of the spectra at low kinetic energy. The intensity of the peak is so strong that it greatly exceeds all the valence band features. For SAMs grown on Ag and Au, the sharp peak represents about 68% and 17% of the total electron yield respectively. This peak intensity is several times stronger than its analog peak for a hydrogen terminated diamond surface. Even with a logarithmic plot (insets), one can still see a sharp feature instead of the typical broad secondary electron background at this energy range.

In order to make sure that this unusual electron emission is from the top diamondoid monolayers, we tried two different ways to cover or remove the top monolayer in-situ. FIG. 3*b* is the PES result on a SAM with $C_{60}$ introduced onto the surface. It is seen that the sharp emission feature vanished after covering the surface with $C_{60}$. Interestingly, the valence band of the $C_{60}$ covered surface is neither from tetramantanethiol nor from $C_{60}$. This may be due to some reaction between the tetramantanethiol and $C_{60}$ molecules, which is not covered in this report. Also, we tried to remove the top diamondoid layer by annealing a SAM in-situ at 825° K. As shown in FIG. 3*c*, the low kinetic energy peak completely disappears after the annealing.

To further test the function of the thiol group attached to the diamondoid molecule, we measured underivitized [121] tetramantane films prepared in-situ. FIG. 4*b* shows the PES spectrum collected on these tetramantane films without thiol groups. The film generates only a weak peak at low kinetic energy. Note that the intensity of all the valance band features in FIG. 3 and FIG. 4 is at the same scale, much lower than that of the unusual low energy features seen in FIG. 3*a* and FIG. 4*a*. This directly shows that the thiol group plays an important role in boosting the electron emission.

FIG. 5 shows the unusual electron emission feature detected by using different photon energies. The sharp feature remains at the same energy, ruling out any possibility of core level excitations. The stability of the peak position in FIG. 5 strongly suggests that the unusual emission feature is not from electrons directly excited by photons, but from electrons accumulated at an intrinsic energy level of the molecules themselves.

PES has been widely employed for studying NEA materials, and a sharp feature at low kinetic energy threshold is cited as evidence of NEA. Diamondoids share the same structure as H-diamond which exhibits NEA and a recent theoretical modeling approach suggested that NEA could exist in diamondoids. The outstanding peak shown in this report provides direct evidence that certain functionalized diamondoids are NEA materials, although we were not able to check the criteria based on band gap value.

Diamondoid SAMs appear to have many advantages over other electron emitters. For one, they can be easily and uniformly grown over large areas Furthermore, since wide band-gap semiconductors are bad electron conductors, without a good compensation for the electron loss on the emission surfaces, the space-charge seriously limits the emission ability. On a diamondoid SAM surface, electron conduction from the electron reservoir (metal substrate) to the emission surface is through a single molecule, which successfully avoids the low conductivity problem and greatly enhances the election emission. The sulphur atoms between diamondoid molecules and substrates may also play a role in bridging the electrons transferred from the substrate to the diamondoids. This may explain why the emission peak is much stronger for tetramantanethiol SAMs than for tetramantane films, suggesting the importance of electron conductance for employing NEA materials for applications. Furthermore, functionalized diamondoid SAMs have the advantage over all bulk NEA materials of sharper energy distribution.

In summary, the discovery of a spectacular electron emission property of functionalized diamondoids that appears to be much superior to other bulk NEA semiconductors has been discovered. The physics responsible for this novel emission property is not understood at this stage. Naively, one may consider that photoexcited electrons lose energy by creating phonons in the molecules. However, this would likely lead to the destruction of the molecules. The more likely scenario is that the excited electrons from the metal substrates create particle-hole pairs. With the holes quickly filled by electrons from substrate, a number of electrons slightly above the bottom of the conduction band are transferred to the diamondoids which further lower their energy to reach to the bottom of the conduction band through phonon emission at the interface or on the molecule. These electrons then are emitted, contributing to the sharp peak. Other properties of diamondoid molecules which are not well understood may also contribute to the unique peak. An important aspect is the use of a monolayer, i.e., single molecule layer, of a diamondoid, and most preferably a higher diamondoid.

New technologies and applications are now possible. The unusual field emission properties described here, the recent findings leading to the availability of higher diamondoids such as the tetramantane used in this study, the newly-shown ability to specifically functionalize higher diamondoids, along with the low-cost for large area SAM manufacturing make the diamondoids desirable materials. Possible devices and applications include: flat panel displays, microwave amplifiers, electron microscopy and electron beam lithography, vacuum microelectronic devices, solid state lighting, and X-ray detectors.

Many modifications of the exemplary embodiments of the invention disclosed above will readily occur to those skilled in the art. Accordingly, the invention is to be construed as including all structure and methods that fall within the scope of the appended claims.

What is claimed is:

1. An electron emitter which comprises a diamondoid monolayer, wherein the emission process of the electron emitter involves electron tunneling emission, and the diamondoid layer comprises a silane derivatized higher diamondoid.

2. The electron emitter of claim 1, wherein the electron affinity of a surface of the diamondoid monolayer is negative.

3. The electron emitter of claim 1, wherein the diamondoid monolayer is on a conductive or semiconductor substrate.

4. The electron emitter of claim 3, wherein the substrate is comprised of gold, silver, silicon, platinum, palladium, aluminum or copper.

5. The electron emitter of claim 3, wherein the substrate is a silicon substrate.

6. An electron display device comprising the electron emitter of claim 1.

7. The electron display device of claim 6, wherein the device is a flat panel display, a microwave amplifier, an electron microscope, an electron beam lithograph, a vacuum microelectronic device, solid state lighting, or an x-ray detector.

8. The electron display device of claim 7, wherein the diamondoid monolayer is a self-assembled monolayer.

9. A flat panel display device comprising the electron emitter of claim 1.

10. A X-ray detector comprising the electron emitter of claim 1.

11. A method of altering the band structure of a substrate, which comprises:

a) selecting a suitable substrate for electron emission by electron tunneling emission; and b) applying a monolayer of a silane derivatized higher diamondoid thereon.

12. The method of claim 11, wherein the surface of the diamondoid monolayer has an electron affinity that is negative.

13. A method of emitting monochromatic electrons, comprising applying a narrowly defined energy potential to an electron emitter comprised of a silane derivatized higher diamondoid monolayer on a substrate to effect the emission of monochromatic electrons by electron tunneling emission.

* * * * *